US010889784B2

(12) United States Patent
Bauer et al.

(10) Patent No.: US 10,889,784 B2
(45) **Date of Patent: *Jan. 12, 2021**

(54) ANTI-GREYING AGENT

(71) Applicant: BASF SE, Ludwigshafen am Rhein (DE)

(72) Inventors: Frederic Bauer, Ludwigshafen am Rhein (DE); Claudia Esper, Ludwigshafen am Rhein (DE)

(73) Assignee: BASF SE

( * ) Notice: Subject to any disclaimer, the term of this patent is extended or adjusted under 35 U.S.C. 154(b) by 40 days.

This patent is subject to a terminal disclaimer.

(21) Appl. No.: 16/310,256

(22) PCT Filed: Jul. 3, 2017

(86) PCT No.: PCT/EP2017/066425

§ 371 (c)(1),
(2) Date: Dec. 14, 2018

(87) PCT Pub. No.: WO2018/007281

PCT Pub. Date: Jan. 11, 2018

(65) Prior Publication Data

US 2019/0345414 A1 Nov. 14, 2019

(30) Foreign Application Priority Data

Jul. 5, 2016 (EP) ..... 16178025

(51) Int. Cl.

| | |
|---|---|
| ***C11D 1/825*** | (2006.01) |
| ***C11D 3/22*** | (2006.01) |
| ***C11D 1/66*** | (2006.01) |
| ***C11D 3/00*** | (2006.01) |

(52) U.S. Cl.

CPC ..... *C11D 3/221* (2013.01); *C11D 1/662* (2013.01); *C11D 1/825* (2013.01); *C11D 3/0036* (2013.01)

(58) Field of Classification Search

CPC ..... C11D 1/662; C11D 1/825; C11D 3/22
See application file for complete search history.

(56) References Cited

U.S. PATENT DOCUMENTS

| | | | | |
|---|---|---|---|---|
| H171 | H * | 12/1986 | McDaniel | 510/470 |
| 5,688,930 | A | 11/1997 | Bertho et al. | |
| 6,156,543 | A | 12/2000 | Bertho et al. | |
| 6,462,006 | B1 | 10/2002 | Sorg et al. | |
| 6,774,113 | B2 | 8/2004 | Bertho et al. | |
| 6,963,014 | B1 | 11/2005 | Zeller et al. | |
| 9,738,858 | B2 * | 8/2017 | Bauer | C11D 3/2017 |
| 9,777,246 | B2 * | 10/2017 | Bauer | C07H 15/04 |
| 9,845,446 | B2 * | 12/2017 | Bauer | C11D 1/825 |
| 10,184,094 | B2 * | 1/2019 | Bauer | C07H 15/04 |
| 2015/0368588 | A1 * | 12/2015 | Bauer | C07H 1/00 510/365 |

FOREIGN PATENT DOCUMENTS

| | | | |
|---|---|---|---|
| DE | 69504158 | T2 | 3/1999 |
| DE | 19819187 | A1 | 11/1999 |
| DE | 19944543 | A1 | 3/2001 |
| DE | 69712602 | T2 | 1/2003 |
| EP | 0851023 | A2 | 7/1998 |
| EP | 1230200 | A2 | 8/2002 |
| FR | 2967164 | A1 | 5/2012 |
| WO | WO-9823566 | A1 | 6/1998 |
| WO | WO-0136356 | A2 | 5/2001 |
| WO | WO-2015000792 | A1 | 1/2015 |
| WO | WO-2015091160 | A1 | 6/2015 |

OTHER PUBLICATIONS

U.S. Appl. No. 16/310,186, filed Dec. 14, 2018, Bauer et al.
International Preliminary Examination Report for PCT/EP2017/066848 dated Jun. 8, 2018.
International Search Report for PCT/EP2017/066425 dated Jul. 28, 2017.
International Search Report for PCT/EP2017/066848 dated Aug. 2, 2017.
Written Opinion of the International Searching Authority for PCT/EP2017/066425 dated Jul. 28, 2017.
Written Opinion of the International Searching Authority for PCT/EP2017/066848 dated Aug. 2, 2017.

* cited by examiner

*Primary Examiner* — Brian P Mruk
(74) *Attorney, Agent, or Firm* — Faegre Drinker Biddle & Reath LLP

(57) ABSTRACT

The present invention refers to the use of a composition comprising two or more compounds of the general formula (I) as anti-greying agent in a laundry process.

19 Claims, No Drawings

ANTI-GREYING AGENT

CROSS-REFERENCE TO RELATED APPLICATIONS

This application is a national stage application (under 35 U.S.C. § 371) of PCT/EP2017/066425, filed Jul. 3, 2017, which claims benefit of European Application No. 16178025.9, filed Jul. 5, 2016, both of which are incorporated herein by reference in their entirety.

FIELD OF THE INVENTION

The present invention refers to the use of a composition comprising two or more compounds of the general formula (I) as anti-greying agent in a laundry process.

BACKGROUND OF THE INVENTION

Detergent compositions are well known in the art and can be formulated in a number of different ways to address a number of different problems. For example, such compositions may comprise a great variety of compounds such as builders, optical brighteners, dispersants, enzymes, perfumes, surfactants (anionic, nonionic, cationic and/or amphotheric), soaps, silicon based defoamers, bleaching agents, colorants, dye transfer inhibitors, complexing agents etc., in order to address various problems encountered in cleaning processes. Furthermore, such compositions are typically formulated such that they are effective against the broadest possible spectrum of stains. This need is addressed by providing compositions comprising one or more agent(s) which is/are broadly effective in their cleaning performance.

However, one particular problem which arises during the washing process of laundry is that redeposition of soil typically occurs which leads to a general greying of fabrics. In order to reduce redeposition of soil, specific native or modified polysaccharides such as polysaccharides treated with gaseous or liquid $SO_2$ (see e.g. WO 2015/091160 A1) have been developed and can be added to the laundry formulation. However, the anti-greying performance of such compounds is still not sufficient.

Therefore, there is a continuous need for alternative anti-greying agents which can be used in a laundry process. In particular, it is desirable to provide an anti-greying agent which reduces greying of a washed fabric. Furthermore, it is desirable to provide an anti-greying agent which can be formulated in a dry or liquid formulation.

Accordingly, it is an object of the present invention to provide a compound or composition that can be used as anti-greying agent in a laundry process. Furthermore, it is an object of the present invention to provide a compound or composition which reduces greying of a washed fabric. It is another object of the present invention to provide a compound or composition that can be formulated in a dry or liquid formulation.

SUMMARY OF THE INVENTION

The foregoing and other objects are solved by the subject-matter of the present invention.

According to the present invention, the use of a composition comprising two or more compounds of the general formula (I),

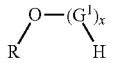

(I)

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, as anti-greying agent in a laundry process is provided.

The inventors surprisingly found out that the composition comprising two or more compounds of the general formula (I), as defined herein, can be used as anti-greying agent in a laundry process. Furthermore, the composition comprising two or more compounds of the general formula (I), as defined herein, reduces greying of a washed fabric. Furthermore, the composition comprising two or more compounds of the general formula (I), as defined herein, can be formulated in a dry or liquid formulation.

Advantageous embodiments of the inventive use of a composition comprising two or more compounds of the general formula (I) are defined in the corresponding subclaims.

According to one embodiment, in the general formula (I) R is unsubstituted branched $C_9$-$C_{13}$-alkyl, preferably unsubstituted branched $C_9$- or $C_{10}$- or $C_{13}$-alkyl, and most preferably unsubstituted branched $C_{10}$- or $C_{13}$-alkyl.

According to another embodiment, in the general formula (I) $G^1$ is selected from the group consisting of glucose, xylose, arabinose, rhamnose and mixtures thereof, and/or x is in the range of from 1.05 to 2.5 and preferably in the range of from 1.10 to 1.8.

According to yet another embodiment, in the general formula (I) R is unsubstituted branched $C_{10}$- or $C_{13}$-alkyl, preferably unsubstituted branched $C_{13}$-alkyl, and $G^1$ is glucose and/or xylose and x is in the range of from 1.05 to 2.5.

According to one embodiment, in the general formula (I) R is unsubstituted branched $C_{13}$-alkyl and $G^1$ is glucose and x is in the range of from 1.10 to 1.8.

According to another embodiment, in the general formula (I) R has an average number of branching in the range from 0.9 to 3.5, more preferably from 1.8 to 3.5 and most preferably from 2.0 to 2.5.

According to yet another embodiment, the two or more compounds of the general formula (I) differ in R.

According to one embodiment, the laundry process is carried out at a temperature ranging from 5 to 120° C.

According to another embodiment, the anti-greying agent is formulated in a dry or liquid formulation.

According to yet another embodiment, the formulation further comprises additives selected from the group comprising anionic surfactants, nonionic surfactants, cationic surfactants, amphoteric surfactants, enzymes, bleaching agents, peroxygen compounds, optical brightener, complexing agents, polymers, e.g. polycarboxylates, soaps, silicon based defoamers, bleaching agents, colorants, dye transfer inhibitors and mixtures thereof.

According to one embodiment, the formulation is a single dose formulation or a high concentrated powder formulation having a bulk density of above 600 g/l.

According to another embodiment, the anti-greying agent reduces greying of a washed fabric.

In the following, the details and preferred embodiments of the inventive use of the composition comprising two or more compounds of the general formula (I) will be described in more detail.

DETAILED DESCRIPTION OF THE INVENTION

A composition comprising two or more compounds of the general formula (I),

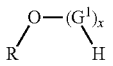

(I)

wherein R is unsubstituted branched $C_9$-$C_{15}$-alkyl, $G^1$ is selected from monosaccharides with 5 or 6 carbon atoms; x is in the range of from 1 to 10 and refers to average values and wherein the two or more compounds differ in R and/or $G^1$ and/or x is used as anti-greying agent in a laundry process.

It was surprisingly found out by the inventors that said composition comprising two or more compounds of the general formula (I) shows anti-greying performance, and thus can be used as anti-greying agent. In particular, it was found out that said composition comprising two or more compounds of the general formula (I) reduces greying of a washed fabric. Furthermore, it was found out that said composition comprising two or more compounds of the general formula (I) can be formulated in a dry or liquid formulation.

In the general formula (I), R is unsubstituted branched $C_9$-$C_{15}$-alkyl, preferably unsubstituted branched $C_9$-$C_{13}$-alkyl, more preferably unsubstituted branched $C_9$- or $C_{10}$- or $C_{13}$-alkyl, and most preferably unsubstituted branched $C_{10}$- or $C_{13}$-alkyl. For example, R is unsubstituted branched $C_{13}$-alkyl.

It is appreciated that R is preferably obtained by a hydroformulation process as described in WO 01/36356 A2, which is thus incorporated herewith by reference.

As used herein, the term "branched alkyl" is a radical of a saturated branched aliphatic group having an average number of branching of at least 0.7 as defined below. Preferably, the term "branched alkyl" refers to a radical of a saturated branched aliphatic group having an average number of branching of ranging from 0.9 to 3.5, more preferably ranging from 1.8 to 3.5 and most preferably from 2.0 to 2.5 as defined below. It is appreciated that the number of carbon atoms includes carbon atoms along the chain backbone as well as branching carbons.

As used herein, the phrase average number of branches per molecule chain refers to the average number of branches per alcohol molecule which corresponds to the corresponding branched alkyl, as measured by $^{13}C$ Nuclear Magnetic Resonance ($^{13}C$ NMR). The average number of carbon atoms in the chain are determined by gas chromatography.

Various references will be made throughout this specification and the claims to the percentage of branching at a given carbon position, the percentage of branching based on types of branches, average number of branches, and percentage of quaternary atoms. These amounts are to be measured and determined by using a combination of the following three $^{13}C$-NMR techniques.

(1) The first is the standard inverse gated technique using a 45-degree tip $^{13}C$ pulse and 10 s recycle delay (an organic free radical relaxation agent is added to the solution of the branched alcohol in deuterated chloroform to ensure quantitative results). (2) The second is a J-Modulated Spin Echo NMR technique (JMSE) using a 1/J delay of 8 ms (J is the 125 Hz coupling constant between carbon and proton for these aliphatic alcohols). This sequence distinguishes carbons with an odd number of protons from those bearing an even number of protons, i.e. $CH_3$/CH vs $CH_2$/Cq (Cq refers to a quaternary carbon) (3) The third is the JMSE NMR "quat-only" technique using a ½J delay of 4 ms which yields a spectrum that contains signals from quaternary carbons only. The JSME NMR quat only technique for detecting quaternary carbon atoms is sensitive enough to detect the presence of as little at 0.3 atom % of quaternary carbon atoms. As an optional further step, if one desires to confirm a conclusion reached from the results of a quat only JSME NMR spectrum, one may also run a DEPT-135 NMR sequence. The DEPT-135 NMR sequence may be very helpful in differentiating true quaternary carbons from breakthrough protonated carbons. This is due to the fact that the DEPT-135 sequence produces the "opposite" spectrum to that of the JMSE "quat-only" experiment. Whereas the latter nulls all signals except for quaternary carbons, the DEPT-135 nulls exclusively quaternary carbons. The combination of the two spectra is therefore very useful in spotting non quaternary carbons in the JMSE "quatonly" spectrum. When referring to the presence or absence of quaternary carbon atoms throughout this specification, however, it is meant that the given amount or absence of the quaternary carbon is as measured by the quat only JSME NMR method. If one optionally desires to confirm the results, then also using the DEPT-135 technique to confirm the presence and amount of a quaternary carbon.

For example, the branched $C_{13}$-alkyl has an average number of branching of from 0.9 to 3.5, more preferably ranging from 1.8 to 3.5 and most preferably from 2.0 to 2.5. The number of branching is defined as the number of methyl groups in one molecule of the corresponding alcohol of the branched alkyl minus 1. The average number of branching is the statistical average of the number of branching of the molecules of a sample.

The branched alkyl can be characterized by the NMR technique as having from 5 to 25% branching on the $C_2$ carbon position, relative to the ether group. In a preferred embodiment, from 10 to 20% of the number of branches are at the $C_2$ position, as determined by the NMR technique. The branched alkyl also generally has from 10% to 50% of the number of branches on the $C_3$ position, more typically from 15% to 30% on the $C_3$ position, also as determined by the NMR technique. When coupled with the number of branches seen at the $C_2$ position, the branched alkyl in this case contain significant amount of branching at the $C_2$ and $C_3$ carbon positions.

Thus, the branched alkyl of the present invention has a significant number of branches at the $C_2$ and $C_3$ positions. Additionally or alternatively, the branched alkyl preferably has ≤7%, more preferably ≤5%, of isopropyl terminal type of branching, as determined by the NMR technique, meaning methyl branches at the second to last carbon position in the backbone relative to the ether group.

In one embodiment, the branching occurs across the length of the carbon backbone. It is however preferred that at least 20%, more preferably at least 30%, of the branches are concentrated at the $C_2$, $C_3$, and isopropyl positions. Alternatively, the total number of methyl branches number is at least 40%, even at least 50%, of the total number of branches, as measured by the NMR technique described above. This percentage includes the overall number of methyl branches seen by the NMR technique described above within the $C_1$ to the $C_3$ carbon positions relative to the ether group, and the terminal isopropyl type of methyl branches.

The branched alkyl, its characterization and synthesis are further described in WO, 01/36356 A2, WO98/23566 A1 and EP1230200 A1 which are thus herewith incorporated by reference.

The term "unsubstituted" means that the branched alkyl group is free of substituents, i.e. the branched alkyl group is composed of carbon and hydrogen atoms only.

In one embodiment, the two or more compounds of the composition differ in R. Preferably, the composition comprises a mixture of two or more compounds of the general formula (I) differing in R, while $G^1$ and x are the same. If the two or more compounds of the composition differ in R, R may differ in the number of carbon atoms (i.e. the length) or the kind of branching.

For example, if the two or more compounds of the composition differ in the number of carbon atoms (i.e. the length), one of the two or more compounds is a compound, wherein R is unsubstituted branched $C_9$-alkyl, and one or more compound(s) of the two or more compounds is a compound, wherein R is unsubstituted branched $C_{10}$-alkyl, unsubstituted branched $C_{11}$-alkyl, unsubstituted branched $C_{12}$-alkyl, unsubstituted branched $C_{13}$-alkyl, unsubstituted branched $C_{14}$-alkyl and/or unsubstituted branched $C_{15}$-alkyl.

Alternatively, if the two or more compounds of the composition differ in the kind of branching, it is appreciated that the two or more compounds are compounds having the same number of carbon atoms (i.e. the length), but the branching across the length of the carbon backbone is different. For example, each of the two or more compounds are unsubstituted branched $C_{13}$-alkyl, wherein R differs in the branching across the length of the carbon backbone. Accordingly, R is a mixture of different unsubstituted branched $C_9$-$C_{15}$-alkyl.

If R is a mixture of different unsubstituted branched $C_9$-$C_{15}$-alkyl, it is appreciated that it is not excluded that the inventive composition comprises minor amounts of R being unsubstituted straight-chain $C_9$-$C_{15}$-alkyl, i.e. $C_9$-$C_{15}$-alkyl being free of branches. For example, the composition comprising two or more compounds of the general formula (I), comprises one or more compounds, wherein R is unsubstituted straight-chain $C_9$-$C_{15}$-alkyl, in an amount of s 1.0 wt.-%, based on the total weight of the composition.

Preferably, the two or more compounds of the composition differ in R.

The two or more compounds of the general formula (I) are preferably obtained by the corresponding glycosylation of a mixture of alcohols. It is to be noted that the mixture of alcohols is preferably obtained by hydroformylating and optionally hydrogenation of a trimer butene or a tetramer propene, more preferably of a trimer butene. A process for preparing the mixture of alcohols is e.g. described in WO, 01/36356 A2 which is thus herewith incorporated by reference.

In the general formula (I), $G^1$ is selected from monosaccharides with 5 or 6 carbon atoms. For example, $G^1$ is selected from pentoses, and hexoses. Examples of pentoses are ribulose, xylulose, ribose, arabinose, xylose and lyxose. Examples of hexoses are galactose, mannose, rhmanose and glucose. Monosaccharides may be synthetic or derived or isolated from natural products, hereinafter in brief referred to as natural saccharides or natural polysaccharides, and natural saccharides natural polysaccharides being preferred. More preferred are the following natural monosaccharides: glucose, xylose, arabinose, rhamnose and mixtures of the foregoing, even more preferred are glucose and/or xylose, and in particular glucose. Monosaccharides can be selected from any of their enantiomers, naturally occurring enantiomers and naturally occurring mixtures of enantiomers being preferred. Naturally, in a specific molecule only whole groups of $G^1$ can occur.

Thus, if $G^1$ in the general formula (I) is a pentose, the pentose may be selected from ribulose such as D-ribulose, L-ribulose and mixtures thereof, preferably D-ribulose, xylulose such as D-xylulose, L-xylulose and mixtures thereof, preferably D-xylulose, ribose such as D-ribose, L-ribose and mixtures thereof, preferably D-ribose, arabinose such as D-arabinose, L-arabinose and mixtures thereof, preferably L-arabinose, xylose such as D-xylose, L-xylose and mixtures thereof, preferably D-xylose and lyxose such as D-lyxose, L-lyxose and mixtures thereof, preferably D-lyxose. If $G^1$ in the general formula (I) is a hexose, the hexose may be selected from galactose such as D-galactose, L-galactose and mixtures thereof, preferably D-galactose, mannose such as D-mannose, L-mannose and mixtures thereof, preferably D-mannose, rhamnose such as D-rhamnose, L-rhamnose and mixtures thereof, preferably L-rhamnose and glucose such as D-glucose, L-glucose and mixtures thereof, preferably D-glucose. More preferably, $G^1$ in the general formula (I) is glucose, preferably D-glucose, xylose, preferably D-xylose, arabinose, preferably D-arabinose, rhamnose, preferably L-rhamnose, and mixtures of the foregoing, even more preferably $G^1$ in the general formula (I) is glucose, preferably D-glucose, and/or xylose, preferably D-xylose, and/or arabinose, preferably D-arabinose. For example, $G^1$ in the general formula (I) is glucose, preferably D-glucose.

In one embodiment of the present invention, $G^1$ is selected from monosaccharides with 6 carbon atoms, preferably from glucose, preferably D-glucose.

In one embodiment, $G^1$ is selected from monosaccharides with 5 or 6 carbon atoms, which are obtained from a fermentative process of a biomass source. The biomass source may be selected from the group comprising pine wood, beech wood, wheat straw, corn straw, switchgrass, flax, barley husk, oat husk, bagasse, *Miscanthus* and the like.

Thus, it is appreciated that $G^1$ can comprise a mixture of monosaccharides with 5 or 6 carbon atoms.

Preferred mixtures of monosaccharides with 5 or 6 carbon atoms include, but are not limited to, a mixture of xylose and glucose or a mixture of xylose and arabinose and optionally glucose. Thus, $G^1$ is preferably a mixture of xylose and glucose or a mixture of xylose and arabinose and optionally glucose.

If the mixture of monosaccharides with 5 or 6 carbon atoms comprises a mixture of glucose and xylose, the weight ratio of glucose to xylose may vary in a wide range, depending on the biomass source used. For example, if the mixture of monosaccharides with 5 or 6 carbon atoms comprises a mixture of glucose and xylose, the weight ratio of glucose to xylose (glucose [wt.-%]/xylose [wt.-%]) in the mixture is preferably from 20:1 to 1:10, more preferably from 10:1 to 1:5, even more preferably from 5:1 to 1:2 and most preferably from 3:1 to 1:1.

If the mixture of monosaccharides with 5 or 6 carbon atoms comprises a mixture of xylose and arabinose, the weight ratio of xylose to arabinose may vary in a wide range, depending on the biomass source used. For example, if the mixture of monosaccharides with 5 or 6 carbon atoms comprises a mixture of xylose and arabinose, the weight ratio of xylose to arabinose (xylose [wt.-%]/arabinose [wt.-%]) in the mixture is preferably from 150:1 to 1:10, more preferably from 100:1 to 1:5, even more preferably from 90:1 to 1:2 and most preferably from 80:1 to 1:1. If the mixture of monosaccharides with 5 or 6 carbon atoms comprises a mixture of glucose and xylose and arabinose, the weight ratio of glucose to xylose to arabinose may vary in a wide range, depending on the biomass source used. For example, if the mixture of monosaccharides with 5 or 6 carbon atoms comprises a mixture of glucose and xylose and arabinose, the weight ratio of glucose to arabinose (glucose [wt.-%]/arabinose [wt.-%]) in the mixture is preferably from 220:1 to 1:20, more preferably from 200:1 to 1:15, even more preferably from 190:1 to 1:10 and most preferably from 180:1 to 1:8. Additionally or alternatively, the weight ratio of xylose to arabinose (xylose [wt.-%]/arabinose [wt.-%]) in the mixture is preferably from 150:1 to 1:20, more preferably from 120:1 to 1:15, even more preferably from 100:1 to 1:10 and most preferably from 80:1 to 1:8. Additionally or alternatively, the weight ratio of glucose to xylose (glucose [wt.-%]/xylose [wt.-%]) in the mixture is preferably from 150:1 to 1:20, more preferably from 120:1 to 1:15, even more preferably from 100:1 to 1:10 and most preferably from 80:1 to 1:8.

Further mixtures of monosaccharides with 5 or 6 carbon atoms are disclosed in DE69504158T2, DE69712602T2, FR2967164, and U.S. Pat. No. 6,774,113, which contents are thus herewith incorporated by references.

In one embodiment, especially if $G^1$ is obtained from a fermentative process of a biomass source, $G^1$ may comprise minor amounts of monosaccharides differing from the monosaccharides with 5 or 6 carbon atoms.

Preferably, $G^1$ comprises ≤10 wt.-%, more preferably ≤5 wt.-%, based on the total weight of the monosaccharide, of monosaccharides differing from the monosaccharides with 5 or 6 carbon atoms. That is to say, $G^1$ comprises ≥90 wt.-%, more preferably ≥95 wt.-%, based on the total weight of the monosaccharide, of the monosaccharides with 5 or 6 carbon atoms.

In the general formula (I), x (also named degree of polymerization (DP)) is in the range of from 1 to 10, preferably x is in the range of from 1.05 to 2.5 and most preferably x is in the range of from 1.10 to 1.8, e.g. from 1.1 to 1.4. In the context of the present invention, x refers to average values, and x is not necessarily a whole number. In a specific molecule only whole groups of $G^1$ can occur. It is preferred to determine x by high temperature gas chromatography (HTGC), e.g. 400° C., in accordance with K. Hill et al., Alkyl Polyglycosides, VCH Weinheim, New York, Basel, Cambridge, Tokyo, 1997, in particular pages 28 ff., or by HPLC. In HPLC methods, x may be determined by the Flory method. If the values obtained by HPLC and HTGC are different, preference is given to the values based on HTGC.

Thus, it is preferred that in the composition comprising two or more compounds of the general formula (I), (I)

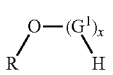

R is unsubstituted branched $C_9$-$C_{13}$-alkyl; $G^1$ is selected from the group consisting of glucose, xylose, arabinose, rhamnose and mixtures thereof; and x is in the range of from 1.05 to 2.5 and refers to average values.

For example, in the composition comprising two or more compounds of the general formula (I), (I)

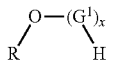

R is unsubstituted branched $C_9$-$C_{13}$-alkyl; $G^1$ is selected from the group consisting of glucose, xylose, arabinose, rhamnose and mixtures thereof; and x is in the range of from 1.10 to 1.8 and refers to average values.

Preferably, in the composition comprising two or more compounds of the general formula (I), (I)

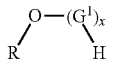

R is unsubstituted branched $C_9$- or $C_{10}$- or $C_{13}$-alkyl; $G^1$ is selected from the group consisting of glucose, xylose, arabinose, rhamnose and mixtures thereof and x is in the range of from 1.05 to 2.5 and refers to average values.

For example, in the composition comprising two or more compounds of the general formula (I), (I)

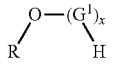

R is unsubstituted branched $C_9$- or $C_{10}$- or $C_{13}$-alkyl; $G^1$ is selected from the group consisting of glucose, xylose, arabinose, rhamnose and mixtures thereof and x is in the range of from 1.10 to 1.8 and refers to average values.

More preferably, in the composition comprising two or more compounds of the general formula (I).

(I)

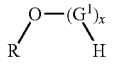

R is unsubstituted branched $C_{10}$- or $C_{13}$-alkyl; $G^1$ is selected from the group consisting of glucose, xylose, arabinose, rhamnose and mixtures thereof and x is in the range of from 1.05 to 2.5 and refers to average values.

For example, in the composition comprising two or more compounds of the general formula (I), (I)

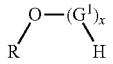

R is unsubstituted branched $C_{10}$- or $C_{13}$-alkyl; $G^1$ is selected from the group consisting of glucose, xylose, arabinose, rhamnose and mixtures thereof and x is in the range of from 1.10 to 1.8 and refers to average values.

Even more preferably, in the composition comprising two or more compounds of the general formula (I),

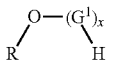

(I)

R is unsubstituted branched $C_{10}$- or $C_{13}$-alkyl; $G^1$ is selected from the group consisting of glucose and/or xylose, and x is in the range of from 1.05 to 2.5 and refers to average values.

For example, in the composition comprising two or more compounds of the general formula (I),

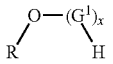

(I)

R is unsubstituted branched $C_{10}$- or $C_{13}$-alkyl; $G^1$ is selected from the group consisting of glucose and/or xylose, and x is in the range of from 1.10 to 1.8 and refers to average values.

In one embodiment, R differs in the branching across the length of the carbon backbone. Accordingly, R is a mixture of different unsubstituted branched $C_{10}$- or $C_{13}$-alkyl.

Most preferably, in the composition comprising two or more compounds of the general formula (I).

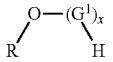

(I)

R is unsubstituted branched $C_{10}$- or $C_{13}$-alkyl; $G^1$ is selected from the group consisting of glucose, and x is in the range of from 1.05 to 2.5 and refers to average values.

For example, in the composition comprising two or more compounds of the general formula (I),

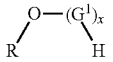

(I)

R is unsubstituted branched $C_{10}$- or $C_{13}$-alkyl; $G^1$ is selected from the group consisting of glucose, and x is in the range of from 1.10 to 1.8 and refers to average values.

In one embodiment, R differs in the branching across the length of the carbon backbone. Accordingly, R is a mixture of different unsubstituted branched $C_{10}$- or $C_{13}$-alkyl.

Especially preferred is the composition comprising two or more compounds of the general formula (I),

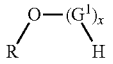

(I)

wherein R is unsubstituted branched $C_{13}$-alkyl; $G^1$ is selected from the group consisting of glucose and/or xylose, and x is in the range of from 1.05 to 2.5 and refers to average values.

For example, in the composition comprising two or more compounds of the general formula (I),

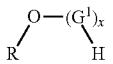

(I)

R is unsubstituted branched $C_{13}$-alkyl; $G^1$ is selected from the group consisting of glucose and/or xylose, and x is in the range of from 1.10 to 1.8 and refers to average values.

In one embodiment, R differs in the branching across the length of the carbon backbone. Accordingly, R is a mixture of different unsubstituted branched $C_{13}$-alkyl.

In particular, the composition comprising two or more compounds of the general formula (I),

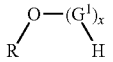

(I)

wherein R is unsubstituted branched $C_{13}$-alkyl; $G^1$ is selected from the group consisting of glucose, and x is in the range of from 1.05 to 2.5 and refers to average values.

For example, in the composition comprising two or more compounds of the general formula (I),

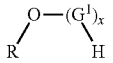

(I)

R is unsubstituted branched $C_{13}$-alkyl; $G^1$ is selected from the group consisting of glucose, and x is in the range of from 1.10 to 1.8 and refers to average values.

In one embodiment, R differs in the branching across the length of the carbon backbone. Accordingly, R is a mixture of different unsubstituted branched $C_{13}$-alkyl.

It is appreciated that two or more compounds of the general formula (I) are provided in the composition.

If the composition comprises, preferably consists of, two or more compounds of general formula (I), the two or more compounds present in the composition differ in the groups R and/or $G^1$ and/or x in the general formula (I). That is to say, the groups R and/or $G^1$ and/or x can be independently selected from each other.

For example, if the composition comprises, preferably consists of, two or more compounds of general formula (I), R may be independently selected from unsubstituted branched $C_9$-$C_{15}$-alkyl, preferably unsubstituted branched $C_9$-$C_{13}$-alkyl, more preferably unsubstituted branched $C_9$- or $C_{10}$- or $C_{13}$-alkyl, and most preferably unsubstituted branched $C_{10}$- or $C_{13}$-alkyl, while $G^1$ and x in the general formula (I) are the same for each compound. Alternatively, x may be independently selected from the range of from 1 to 10, preferably from the range of from 1.05 to 2.5 and most preferably from the range of from 1.10 to 1.8, while R and $G^1$ in the general formula (I) are the same for each compound. Alternatively, $G^1$ may be independently selected from monosaccharides with 5 or 6 carbon atoms, more preferably from the group consisting of glucose, xylose, arabinose, rhamnose and mixtures thereof and most preferably from glucose and/or xylose, while R and x in the general formula (I) are the same for each compound.

Preferably, the two or more compounds of the general formula (I) differ in R. More preferably, the two or more compounds of the general formula (I) differ in R, while $G^1$ and x are the same.

It is appreciated that the compounds of the general formula (I) can be present in the alpha and/or beta conformation. For example, the compound of general formula (I) is in the alpha or beta conformation, preferably alpha conformation. Alternatively, the compound of general formula (I) is in the alpha and beta conformation.

If the compound of general formula (I) is in the alpha and beta conformation, the compound of general formula (I) comprise the alpha and beta conformation preferably in a ratio ($\alpha/\beta$) from 10:1 to 1:10, more preferably from 10:1 to 1:5, even more preferably from 10:1 to 1:4 and most preferably from 10:1 to 1:3, e.g. about 2:1 to 1:2.

The composition comprising two or more compounds of the general formula (I) is preferably formulated in a dry or liquid formulation.

Thus, the present invention refers in a further aspect to a dry or liquid formulation comprising a composition comprising two or more compounds of the general formula (I).

For example, the dry or liquid formulation is a dry or liquid cleaning formulation.

The term "cleaning" is used herein in the broadest sense and means removal of unwanted substances such as oil- and/or fat-containing substances from an object to be cleaned, e.g. fabrics or dishes.

The term "dry formulation" as used herein, refers to formulations that are in a form of a powder, granules or tablets. It is appreciated that the "dry formulation" has a moisture content of ≤20 wt.-%, more preferably ≤15 wt.-%, even more preferably ≤10 wt.-% and most preferably ≤7.5 wt.-%, based on the total weight of the formulation. If not otherwise indicated, the moisture content is determined according to the Karl Fischer method as outlined in DIN EN 13267:2001.

If the dry formulation is provided in form of a powder, the formulation is preferably a high concentrated powder formulation having a bulk density of above 600 g/l.

The term "liquid formulation" as used herein, refers to formulations that are in a form of a "pourable liquid"; "gel" or "paste".

A "pourable liquid" refers to a liquid formulation having a viscosity of <3 000 mPa·s at 25° C. at a shear rate of 20 $sec^{-1}$. For example, the pourable liquid has a viscosity in the range of from 200 to 2 000 mPa·s, preferably from 200 to 1 500 mPa·s and most preferably from 200 to 1 000 mPa·s, at 25° C. at a shear rate of 20 $sec^{-1}$.

A "gel" refers to a transparent or translucent liquid formulation having a viscosity of >2 000 mPa·s at 25° C. at a shear rate of 20 $sec^{-1}$. For example, the gel has a viscosity in the range of from 2 000 to about 10 000 mPa·s, preferably from 5 000 to 10 000 mPa·s, at a shear rate of 0.1 $sec^{-1}$.

A "paste" refers to an opaque liquid formulation having a viscosity of greater than about 2 000 mPa·s at 25° C. and a shear rate of 20 $sec^{-1}$. For example, the paste has a viscosity in the range of from 3 000 to 10 000 mPa·s, preferably from 5 000 to 10 000 mPa·s, at 25° C. at a shear rate of 0.1 $sec^{-1}$.

The dry or liquid formulation is preferably in form of a single dose formulation.

Preferably, the composition comprising two or more compounds of the general formula (I) is formulated in a liquid formulation, more preferably a liquid cleaning formulation.

The dry or liquid formulation, preferably the dry or liquid cleaning formulation, comprises the composition comprising two or more compounds of the general formula (I) preferably in an amount ranging from 0.1 to 80 wt.-%, preferably from 0.1 to 50 wt.-% and most preferably from 0.1 to 25 wt.-%, based on the total weight of the formulation.

It is appreciated that the dry or liquid formulation, preferably the dry or liquid cleaning formulation, may further comprise additives typically used in the kind of formulation to be prepared. For example, the dry or liquid formulation, preferably the dry or liquid cleaning formulation, further comprises additives selected from the group comprising anionic surfactants, nonionic surfactants, cationic surfactants, amphoteric surfactants, enzymes, bleaching agents, peroxygen compounds, optical brightener, complexing agents, polymers, soaps, silicon based defoamers, bleaching agents, colorants, dye transfer inhibitors and mixtures thereof.

Anionic surfactants suitable for the dry or liquid formulation, preferably the dry or liquid cleaning formulation, can be of several different types. For example, the anionic surfactant can be selected from the group comprising alkane sulfonates, olefin sulfonates, fatty acid ester sulfonates, especially methyl ester sulfonates, alkyl phosphonates, alkyl ether phosphonates, sarcosinates, taurates, alkyl ether carboxylates, fatty acid isothionates, sulfosuccinates, $C_8$-$C_{22}$ alkyl sulfates, $C_8$-$C_{22}$ alkyl alkoxy sulfates, $C_{11}$-$C_{13}$ alkyl benzene sulfonate, $C_{12}$-$C_{20}$ methyl ester sulfonate, $C_{12}$-$C_{18}$ fatty acid soap and mixtures thereof.

Nonionic surfactants suitable for the dry or liquid formulation, preferably the dry or liquid cleaning formulation, can be of several different types. For example, the nonionic surfactant can be selected from the group comprising $C_8$-$C_{22}$ alkyl ethoxylates, $C_6$-$C_{12}$ alkyl phenol alkoxylates, preferably ethoxylates and mixed ethoxy/propoxy, block alkylene oxide condensate of $C_6$ to $C_{12}$ alkyl phenols, alkylene oxide condensates of $C_8$-$C_{22}$ alkanols and ethylene oxide/propylene oxide block polymers, alkylpolysaccharides, alkyl polyglucoside surfactants, condensation products of $C_{12}$-$C_{15}$ alcohols with from 5 to 20 moles of ethylene oxide per mole of alcohol, polyhydroxy fatty acid amides, preferably N-methyl N-1-deoxyglucityl cocoamide or N-methyl N-1-deoxyglucityl oleamide, and mixtures thereof. In one embodiment, the nonionic surfactant may be of the formula $R^1(OC_2H_4)_nOH$, wherein $R^1$ is a $C_{10}$-$C_{16}$ alkyl group or a $C_8$-$C_{12}$ alkyl phenyl group, and wherein n is from 3 to about 80.

Additionally or alternatively, the non-ionic surfactant can be a biosurfactant selected from the group comprising rhamnolipid, sophorolipid, glucoselipid, celluloselipid, trehaloselipid, mannosylerythritollipid, lipopeptide and mixtures thereof.

Preferred non-ionic surfactants are glucamides, methylesteralkoxylates, alkoxylated alcohols, di- and multiblock copolymers of ethylene oxide and propylene oxide and reaction products of sorbitan with ethylene oxide or propylene oxide, alkyl polyglycosides (APG), hydroxyalkyl mixed ethers and amine oxides.

Preferred examples of alkoxylated alcohols and alkoxylated fatty alcohols are, for example, compounds of the general formula (III)

(III)

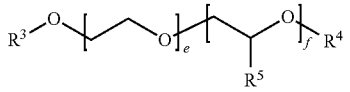

in which the variables are defined as follows:

$R^3$ is selected from $C_8$-$C_{22}$-alkyl, branched or linear, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^4$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, $R^5$ is identical or different and selected from hydrogen and linear $C_1$-$C_{10}$-alkyl, preferably in each case identical and ethyl and particularly preferably hydrogen or methyl, e and f are in the range from zero to 300, where the sum of e and f is at least one, preferably in the range of from 3 to 50. Preferably, e is in the range from 1 to 100 and f is in the range from 0 to 30.

It is appreciated that e and f may be polymerized randomly or as blocks.

In one embodiment, compounds of the general formula (III) may be block copolymers or random copolymers, preference being given to block copolymers.

Other preferred examples of alkoxylated alcohols are, for example, compounds of the general formula (IV)

(IV)

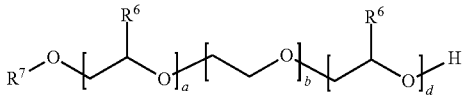

in which the variables are defined as follows:

$R^6$ is identical or different and selected from hydrogen and linear $C_1$-$C_{10}$-alkyl, preferably identical in each case and ethyl and particularly preferably hydrogen or methyl, $R^7$ is selected from $C_6$-$C_{20}$-alkyl, branched or linear, in particular n-$C_8H_{17}$, n-$C_{10}H_{21}$, n-$C_{12}H_{25}$, n-$C_{13}H_{27}$, n-$C_{15}H_{31}$, n-$C_{14}H_{29}$, n-$C_{16}H_{33}$, n-$C_{18}H_{37}$, a is a number in the range from zero to 10, preferably from 1 to 6, b is a number in the range from 1 to 80, preferably from 4 to 20, d is a number in the range from zero to 50, preferably 4 to 25.

The sum a+b+d is preferably in the range of from 5 to 100, even more preferably in the range of from 9 to 50.

Compounds of the general formula (III) and (IV) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl polyglycosides, especially linear $C_4$-$C_{16}$-alkyl polyglucosides and branched $C_8$-$C_{14}$-alkyl polyglycosides such as compounds of general average formula (VI) are likewise suitable.

(VI)

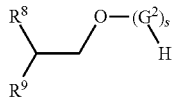

wherein:

$R^8$ is $C_1$-$C_4$-alkyl, in particular ethyl, n-propyl or isopropyl, $R^9$ is —$(CH_2)_2$—$R^7$, $G^2$ is selected from monosaccharides with 4 to 6 carbon atoms, especially from glucose and xylose, s in the range of from 1.1 to 4, s being an average number, Further examples of non-ionic surfactants are compounds of general formula (VII) and (VIII)

(VII)

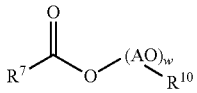

(VIII)

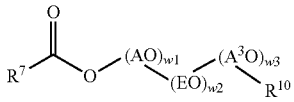

$R^7$ is defined as above in general formula (IV).

AO corresponds to the group f as defined above in general formula (III) or the group a or d as defined above in general formula (IV).

$R^{10}$ selected from $C_8$-$C_{18}$-alkyl, branched or linear.

$A^3O$ is selected from propylene oxide and butylene oxide, w is a number in the range of from 15 to 70, preferably 30 to 50, w1 and w3 are numbers in the range of from 1 to 5, and w2 is a number in the range of from 13 to 35.

An overview of suitable further nonionic surfactants can be found in EP-A 0 851 023 and in DE-A 198 19 187 which are incorporated herewith by reference.

Mixtures of two or more different nonionic surfactants selected from the foregoing may also be present.

Cationic surfactants suitable for the dry or liquid formulation, preferably the dry or liquid cleaning formulation, can be of several different types. For example, useful cationic surfactants can be selected from fatty amines, quaternary ammonium surfactants, imidazoline quat materials and mixtures thereof.

Amphoteric surfactants are also suitable for use in the dry or liquid formulation, preferably the dry or liquid cleaning formulation, and can be of several different types. For example, the amphoteric surfactants can be selected from aliphatic derivatives of secondary or tertiary amines and/or aliphatic derivatives of heterocyclic secondary and tertiary amines in which the aliphatic radical can be a straight- or branched-chain. It is preferred that one of the aliphatic substituents contains at least 8 carbon atoms, preferably from 8 to 18 carbon atoms, and at least one contains an anionic water-solubilizing group, e.g., a carboxy, sulfonate or sulfate group.

The dry or liquid formulation, preferably the dry or liquid cleaning formulation, may also comprise enzymes, such as for the removal of protein-based, carbohydrate-based or triglyceride-based stains. For example, suitable enzymes are selected from the group comprising hemicellulases, peroxidases, proteases, cellulases, xylanases, lipases, phospholipases, esterases, cutinases, pectinases, keratanases, reductases, oxidases, phenoloxidases, lipoxygenases, lignin-ases, pullulanases, tannases, pentosanases, malanases, 3-glucanases, arabinosidases, hyaluronidase, chondroitinase, laccase, amylases, and mixtures thereof. They may be of any suitable origin, such as vegetable, animal, bacterial, fungal and yeast origin.

In one embodiment, the dry or liquid formulation, preferably the dry or liquid cleaning formulation, comprises a mixture of conventional enzymes like protease, lipase, cutinase and/or cellulase in combination with amylase.

Proteases useful herein include those like subtilisins from *Bacillus* [e.g. *Subtilis, Lentus, Licheniformis, Amyloliquefaciens* (BPN, BPN'), *Alcalophilus*] such as the commercial products Esperase®, Alcalase®, Everlase® or Savinase® available from Novozymes. Commercial products of amylases (α and/or β) are for example available as Purafect Ox Am® from Genencor or Termamyl®, Natalase®, Ban®, Fungamyl® and Duramyl® from Novozymes. Suitable lipases include those produced by *Pseudomonas* and Chromobacter groups. The lipolase enzymes can be derived from *Humicola lanuginosa* and are commercially available from Novo or as Lipolase Ultra®, Lipoprime® and Lipeefrom Novozymes. Also suitable are cutinases and esterases. Suitable cellulases include both bacterial and fungal types, typically having a pH optimum between 5 and 10. Examples include fungal cellulases from *Humicola insolens* or *Humicola* strain DSMI 800 or a cellulase 212-producing fungus belonging to the genus *Aeromonas*, and cellulase extracted from the hepatopancreas of a marine mollusk, Dolabella Auricula Solander. CAREZYME® ENDOLASE and CELLUZYME® of Novozymes or the EGIII cellulases from *Trichoderma longibrachiatum* are also suitable.

Bleaching enzymes can be used as bleaching agents e.g. peroxidases, laccases, oxygenases, e.g. catechol 1,2 dioxygenase, lipoxygenase, (non-heme) haloperoxidases.

The peroxygen compounds that can be used in the dry or liquid formulation, preferably the dry or liquid cleaning formulation, are normally compounds which are capable of yielding hydrogen peroxide in aqueous solution and are well known in the art. For example, the peroxygen compounds can be selected from the group comprising alkali metal peroxides, organic peroxides such as urea peroxide, and inorganic persalts, such as the alkali metal perborate such as sodium perborate tetrahydrate or sodium perborate monohydrate, percarbonates, perphosphates, persilicates, alkylhydroxy peroxides such as cumene hydroperoxide or t-butyl hydroperoxide, organic peroxyacids such as monoperoxy acids (e.g. peroxy-α-naphthoic acid, peroxylauric acid, peroxystearic acid and N,N-phthaloylaminoperoxy caproic acid (PAP), 6-octylamino-6-oxo-peroxyhexanoic acid, 1,12-diperoxydodecanedioic acid (DPDA), 2-decylperoxybutane-1,4-dioic acid or 4,4'-sulphonylbisperoxybenzoic acid) and mixtures thereof.

Optical brighteners include any compound that exhibits fluorescence, including compounds that absorb UV light and reemit as "blue" visible light. In particular, suitable optical brighteners absorb light in the ultraviolet portion of the spectrum between about 275 nm and about 400 nm and emit light in the violet to violet-blue range of the spectrum from about 400 nm to about 500 nm. For example, the optical brighteners contain an uninterrupted chain of conjugated double bonds. Examples of suitable optical brighteners include derivatives of stilbene or 4,4'-diaminostilbene, biphenyl, five-membered heterocycles such as triazoles, oxazoles, imidiazoles, etc., or six-membered heterocycles (e.g. coumarins, naphthalamide, s-triazine, etc.). Cationic, anionic, nonionic, amphoteric and zwitterionic optical brightener can be used in the present dry or liquid formulation, preferably the dry or liquid cleaning formulation.

The dry or liquid formulation, preferably the dry or liquid cleaning formulation, may also comprise complexing agents, e.g. iron and manganese complexing agents. Such complexing agents can be selected from the group comprising amino carboxylates, amino phosphonates, polyfunctionally-substituted aromatic complexing agents and mixtures thereof. Suitable complexing agents are selected from the alkali metal salts of aminocarboxylic acids and from alkali metal salts of citric acid, tartaric acid and lactic acid. Alkali metal salts are selected from lithium salts, rubidium salts, cesium salts, potassium salts and sodium salts, and combinations of at least two of the foregoing. Potassium salts and combinations from potassium and sodium salts are preferred and sodium salts are even more preferred.

Examples of aminocarboxylic acids are imino disuccinic acid (IDS), ethylene diamine tetraacetic acid (EDTA), nitrilotriacetic acid (NTA), methylglycine diacetic acid (MGDA) and glutamic acid diacetic acid (GLDA).

The dry or liquid formulation, preferably the dry or liquid cleaning formulation, can contain at least one organic complexing agent (organic cobuilders) such as EDTA (N,N,N',N'-ethylened iaminetetraacetic acid), NTA (N,N,N-nitrilotriacetic acid), MGDA (2-methylglycine-N,N-diacetic acid), GLDA (glutamic acid N,N-diacetic acid), and phosphonates such as 2-phosphono-1,2,4-butanetricarboxylic acid, aminotri(methylenephosphonic acid), 1-hydroxyethylene(1,1-diphosphonic acid) (HEDP), ethylenediaminetetramethylenephosphonic acid, hexamethylenediaminetetramethylenephosphonic acid and diethylenetriaminepentamethylenephosphonic acid and in each case the respective alkali metal salts, especially the respective sodium salts. Preferred are the sodium salts of HEDP, of GLDA and of MGDA.

The dry or liquid formulation, preferably the dry or liquid cleaning formulation, may also comprise polymers, e.g. polycarboxylates.

The dry or liquid formulation, preferably the dry or liquid cleaning formulation, preferably comprises one or more of the above additives (in sum) in an amount ranging from 0.5 to 25 wt.-%, preferably from 0.5 to 20 wt.-% and most preferably from 0.5 to 17.5 wt.-%, based on the total weight of the active materials in the formulation. It is to be noted that the total weight of the active materials in the formulation (if not otherwise indicated) refers to the total weight of the one or more additives and the compound of the general formula (I), i.e. without water.

It is appreciated that the composition comprising two or more compounds of the general formula (I),

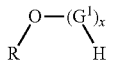

(I)

wherein R is unsubstituted branched $C_9$-$C_{15}$-alkyl, $G^1$ is selected from monosaccharides with 5 or 6 carbon atoms; x is in the range of from 1 to 10 and refers to average values, and wherein the two or more compounds differ in R and/or $G^1$ and/or x, shows exceptional results as anti-greying agent when used in a laundry process.

In particular, the composition comprising two or more compounds of the general formula (I) used as ant-greying agent reduces greying of a washed fabric. The fabric may be selected from a natural fabric, synthetic fabric and mixtures thereof. For example, the natural fabric may be a cotton, linen and/or silk fabric. The synthetic fabric may be a polyester and/or polyamide fabric. A mixed natural/synthetic fabric may be for example a polyester/cotton fabric.

It is appreciated that the anti-greying performance of the composition comprising two or more compounds of the general formula (I), can be achieved over a broad temperature range. Thus, the composition comprising two or more compounds of the general formula (I) is preferably used as anti-greying agent at a temperature ranging from 5 to 120° C. in view of this, the laundry process can be carried out at a temperature ranging from 5 to 120° C., preferably at a temperature ranging from 5 to 100° C. Accordingly, the composition comprising two or more compounds of the general formula (I) is preferably used as anti-greying agent in home care laundry products, industrial laundry products and the like, most preferably home care laundry products.

The scope and interest of the invention will be better understood based on the following examples which are intended to illustrate certain embodiments of the invention and are non-limitative.

EXAMPLES

The excellent anti-greying properties of the composition comprising two or more compounds of formula (I) were demonstrated by using the launder-o-meter in comparison to a compound of the prior art as follows:

Several white test swatches were washed together with soiled fabric EMPA 101/SBL 2004 and 20 steel balls at 40° C. in water with the selected composition comprising two or more compounds of formula (I) or comparative compound. The pH value of the washing liquor was adjusted to 8.0. The compositions comprising two or more compounds used as well as the comparative compounds are outlined in table 1. After the washing, the test fabrics were rinsed and spin-dried. This washing cycle was repeated two times with new soiled fabric and new washing liquor. After the third wash, the test fabrics were rinsed, spin-dried and dried in the air.

TABLE 1

Tested compounds and results

| | Soiling | Δ cotton (BW) | Δ polyester (PES) | sum (ΔBW + Δ PES) |
|---|---|---|---|---|
| C13-C15 Oxo alcohol + 7 mol EO[#] (CE1) | EMPA/SBL | 5.3 | 45.1 | 50.4 |
| branched C13-Glucosid[#1] (IE1) | EMPA/SBL | 15.3 | 43.3 | 58.6 |
| branched C13-Glycosid (66% Glucose/33% Xylose/1% Arabinose)[#2] (IE2) | EMPA/SBL | 25.4 | 26.6 | 52.0 |
| C13-C15 Oxo alcohol + 7 mol EO[#] (CE2) | Clay slurry | 1.6 | 11.6 | 13.2 |
| branched C13-Glucosid[#1] (IE3) | Clay slurry | 26.4 | 24.7 | 51.1 |
| branched C13-Glycosid (66% Glucose/33% Xylose/1% Arabinose)[#2] (IE4) | Clay slurry | 3.6 | 12.9 | 16.5 |

[#]active content: 100 wt.-%, based on the total weight of the composition comprising two or more compounds of formula (I)

[#1]active content: 54 wt.-%, based on the total weight of the composition comprising two or more compounds of formula (I)

[#2]active content: 43 wt-%, based on the total weight of the composition comprising two or more compounds of formula (I)

The washing conditions are outlined in table 2 below.

TABLE 2

Washing conditions:

| | |
|---|---|
| Test equipment | Launder-o-meter, LP2 Typ, SDL Atlas Inc., USA |
| Washing liquor | 250 ml |
| Washing time/temperature | 20 min at 40° C. |
| Dosage | 1 g tested compound/L |
| Fabric/liquor ratio | 1:10 |
| Washing cycles | 3 |
| Water hardness | 2.5 mmol/l $Ca^{2+}$:$Mg^{2+}$:$HCO_3^-$ 4:1:8 |
| Soiling fabric | 2.5 g EMPA 101[5)] |
| | 2.5 g SBL 2004[6)] |
| | 2.5 g clay slurry[7)] |
| Sum test + soiled fabric | 20 g |
| White test fabric, each 10 × 10 cm | wfk 10A, wfk 80A, wfk12A, EMPA 221[1)] |
| | wfk 20A[2)] |
| | wfk 30A[3)] |
| | EMPA 406[4)] |

[1)]Cotton fabrics: wfk 10A, Remission 81.8%; producer: wfk Testgewebe GmbH, Brüggen, Deutschland wfk 80A, Remission 85.7%; producer: wfk Testgewebe GmbH, Brüggen, Deutschland wfk 12A, Remission 94.4%; producer: wfk Testgewebe GmbH, Brüggen, Deutschland EMPA 221, Remission 87.1%; producer: EMPA Testmaterialien AG, Sankt Gallen, Schweiz

[2)]wfk 20 A Polyester/cotton, Remission 83.4%; producer: wfk Testgewebe GmbH, Br üggen, Deutschland

[3)]wfk 30 A Polyester, Remission 81.2%; producer: wfk Testgewebe GmbH, Brüggen, Deutschland

[4)]EMPA 406 Polyamid, Remission 77.1%; producer: EMPA Testmaterialien AG, Sankt Gallen, Schweiz

[5)]EMPA 101, Carbon black/Olive oil; producer: producer: EMPA Testmaterialien AG, Sankt Gallen, Schweiz

[6)]SBL 2004, Soil load sheet; producer: wfk Testgewebe GmbH, Brüggen, Deutschland

[7)]mixture of clay, peanut oil, mineral oil and water

The antigreying performance was determined by measuring the remission value of the soiled fabric before and after wash with the spectrophotometer from Fa. Datacolor (Elrepho 2000) at 460 nm. The higher the value, the better is the performance. The results are also outlined in Table 1 above. From the results, it can be gathered that the inventive compositions comprising two or more compounds of formula (I) show excellent anti-greying performance compared to compounds of the prior art.

The invention claimed is:

1. An anti-greying agent in a laundry process which comprises a composition comprising two or more compounds of the general formula (I),

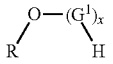

(I)

wherein R is unsubstituted branched $C_{13}$ alkyl and has an average number of branching in the range from 0.9 to 2.9; $G^1$ is selected from monosaccharides with 5 or 6 carbon atoms; x is in the range of from 1 to 1.8 and refers to average values, and wherein the two or more compounds differ in the average number of branching of R and/or $G^1$ and/or x.

2. The agent according to claim 1, wherein $G^1$ is selected from the group consisting of glucose, xylose, arabinose, rhamnose and mixtures thereof, and/or x is in the range of from 1.05 to 1.8.

3. The agent according to claim 1, wherein $G^1$ is selected from the group consisting of glucose, xylose, arabinose, rhamnose and mixtures thereof, and/or x is in the range of from 1.10 to 1.8.

4. The agent according to claim 1, wherein $G^1$ is glucose and/or xylose and x is in the range of from 1.05 to 1.8.

5. The agent according to claim 1, wherein $G^1$ is glucose and x is in the range of from 1.10 to 1.8.

6. The agent according to claim 1, wherein R has an average number of branching in the range from 1.8 to 2.9.

7. The agent according to claim 1, wherein R has an average number of branching in the range from 2.0 to 2.5.

8. The agent according to claim 1, wherein the two or more compounds of the general formula (I) differ in the average number of branching of R.

9. The agent according to claim 1, wherein the laundry process is carried out at a temperature ranging from 5 to 120° C.

10. The agent according to claim 1, wherein the anti-greying agent is formulated in a dry or liquid formulation.

11. The agent according to claim 10, wherein the formulation further comprises additives selected from the group consisting of anionic surfactants, nonionic surfactants, cationic surfactants, amphoteric surfactants, enzymes, bleaching agents, peroxygen compounds, optical brightener, complexing agents, polymers, soaps, silicon based defoamers, bleaching agents, colorants, dye transfer inhibitors and mixtures thereof.

12. The agent according to claim 10, wherein the formulation further comprises additives selected from the group consisting of anionic surfactants, nonionic surfactants, cationic surfactants, amphoteric surfactants, enzymes, bleaching agents, peroxygen compounds, optical brightener, complexing agents, polycarboxylates, soaps, silicon based defoamers, bleaching agents, colorants, dye transfer inhibitors and mixtures thereof.

13. The agent according to claim 10, wherein the formulation is a single dose formulation or a high concentrated powder formulation having a bulk density of above 600 g/l.

14. The agent according to claim 1, wherein the anti-greying agent reduces greying of a washed fabric.

15. The agent according to claim 6, wherein $G^1$ is selected from the group consisting of glucose, xylose, arabinose, rhamnose and mixtures thereof and x is in the range of from 1.10 to 1.8.

16. The agent according to claim 15, wherein R has an average number of branching in the range from 2.0 to 2.5.

17. The agent according to claim 16, wherein the two or more compounds of the general formula (I) differ in the average number of branching of R.

18. The agent according to claim 17, wherein the laundry process is carried out at a temperature ranging from 5 to 120° C.

19. The agent according to claim 18, wherein the anti-greying agent is formulated in a dry or liquid formulation.

* * * * *